US008695305B2

(12) United States Patent
Gallagher

(10) Patent No.: US 8,695,305 B2
(45) Date of Patent: Apr. 15, 2014

(54) TRUSS DEADWEIGHT

(76) Inventor: Joseph Daniel Gallagher, Torrence, CA (US)

( * ) Notice: Subject to any disclaimer, the term of this patent is extended or adjusted under 35 U.S.C. 154(b) by 0 days.

(21) Appl. No.: 13/341,162

(22) Filed: Dec. 30, 2011

(65) Prior Publication Data

US 2013/0167468 A1 Jul. 4, 2013

(51) Int. Cl.
*E04H 12/00* (2006.01)
*E04C 2/38* (2006.01)

(52) U.S. Cl.
USPC ..... 52/655.1; 52/656.9

(58) Field of Classification Search
USPC ..... 52/655.1, 655.2, 251, 252, 259, 165, 52/166, 633, 637, 648.1, 651.01, 651.02, 52/651.05, 651.07
See application file for complete search history.

(56) References Cited

U.S. PATENT DOCUMENTS

| | | | | | |
|---|---|---|---|---|---|
| 2,724,261 | A | * | 11/1955 | Rensaa | 52/295 |
| 3,367,084 | A | * | 2/1968 | Reiland | 52/649.7 |
| 4,248,467 | A | * | 2/1981 | Allen et al. | 294/67.1 |
| 4,409,764 | A | * | 10/1983 | Wilnau | 52/127.3 |
| 4,922,669 | A | * | 5/1990 | De Pas et al. | 52/646 |
| 4,925,330 | A | * | 5/1990 | Cornish | 403/171 |
| 5,372,450 | A | * | 12/1994 | Blodgett | 403/171 |
| 5,678,375 | A | * | 10/1997 | Juola | 52/655.1 |
| 5,680,737 | A | * | 10/1997 | Sheipline | 52/655.1 |
| 5,711,131 | A | * | 1/1998 | Thomas | 52/656.9 |
| 5,930,971 | A | * | 8/1999 | Etheridge | 52/646 |
| 7,516,591 | B2 | * | 4/2009 | Wolner et al. | 52/698 |
| 8,474,204 | B2 | * | 7/2013 | Pan et al. | 52/259 |
| 2005/0108980 | A1 | * | 5/2005 | Barmakian | 52/720.1 |
| 2010/0083605 | A1 | * | 4/2010 | Wallner | 52/655.1 |
| 2010/0229482 | A1 | * | 9/2010 | Lee | 52/223.8 |
| 2012/0005980 | A1 | * | 1/2012 | Kundel et al. | 52/651.05 |
| 2012/0110947 | A1 | * | 5/2012 | Simmons | 52/655.1 |
| 2012/0304584 | A1 | * | 12/2012 | Pan et al. | 52/655.1 |

OTHER PUBLICATIONS

Global Truss. Wayback machine, Oct. 8, 2010 http://web.archive.org/web/20101008064902/http://globaltruss.com/ProductDetails.aspx?ItemNumber=292&MainId=16&Category=37.*

* cited by examiner

*Primary Examiner* — Ryan Kwiecinski
(74) *Attorney, Agent, or Firm* — Kafantaris Law Offices; Theo Kafantaris

(57) ABSTRACT

The deadweight comprises several support members and support frames which define a general cubic shape. A plate is positioned on each face of the cube, with cement filling the center of the deadweight to provide additional weight, stability, and support. Fork lift sleeves are provided to allow easy positioning of the deadweight. Each plate comprises a plurality of apertures for fitting a 12" or 20.5" box truss. A large rectangular aperture is positioned on each side plate, permitting users to reach into an enclosure to bolt the box truss to the desired plate. The bolt apertures are adapted to mount a box truss flush to each plate. A leveling mechanism is provided to ensure the deadweight and box truss will be stable even on uneven ground.

12 Claims, 7 Drawing Sheets

TRUSS DEADWEIGHT

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates generally to a truss deadweight, and more particularly to a weighted device for attaching and securing a box truss in various positions.

DISCUSSION OF RELATED ART

A truss is a structure comprising a matrix of triangular units whose sides are attached to common straight members. This matrix provides several benefits to the truss, including high load bearing capacity, low manufacturing cost, reduced weight, and resistance to bending, buckling, and rotation. A planar truss is defined as a truss with all triangular units and straight members on a single plane, while a box truss extends into three dimensions.

Trusses are often used in construction due to their superior structural properties and low cost. When constructing a portable stage, trusses can be used for holding graphics, lights, monitors, or other devices requiring vertical support. Typically, the trusses are connected using joints, and are held to the ground using ground supports. Common truss sizes include 12" and 20.5".

While several ground supports exist, they do not provide adequate support needed by truss structures carrying heavy loads, especially in unforeseen weather conditions. Therefore, a need exists for a deadweight that can support loaded trusses of several sizes at various attachment positions. The present invention accomplishes these objectives.

SUMMARY OF THE INVENTION

The present device is a deadweight that can support loaded trusses of several sizes at various attachment positions. Several support members and support frames define the general cubic shape of the deadweight, which is filled with cement to provide additional weight for stability and support. Fork lift sleeves are provided to allow easy positioning of the deadweight.

Each face of the cubic deadweight comprises a plate with a plurality of apertures for fitting a 12" or 20.5" box truss. A large rectangular aperture is positioned on each side plate, permitting users to reach into an enclosure to bolt the box truss to the desired plate. The overall size of the deadweight is 3'×3', although a 2'×2' variation is anticipated. The bolt apertures are adapted to mount a box truss flush to each plate. Furthermore, a leveling mechanism is provided to ensure the deadweight and box truss are stable even on uneven ground.

The present invention will provide adequate support for truss structures carrying heavy loads, especially during unforeseen weather conditions. Other features and advantages of the present invention will become apparent from the following detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Figure 1:
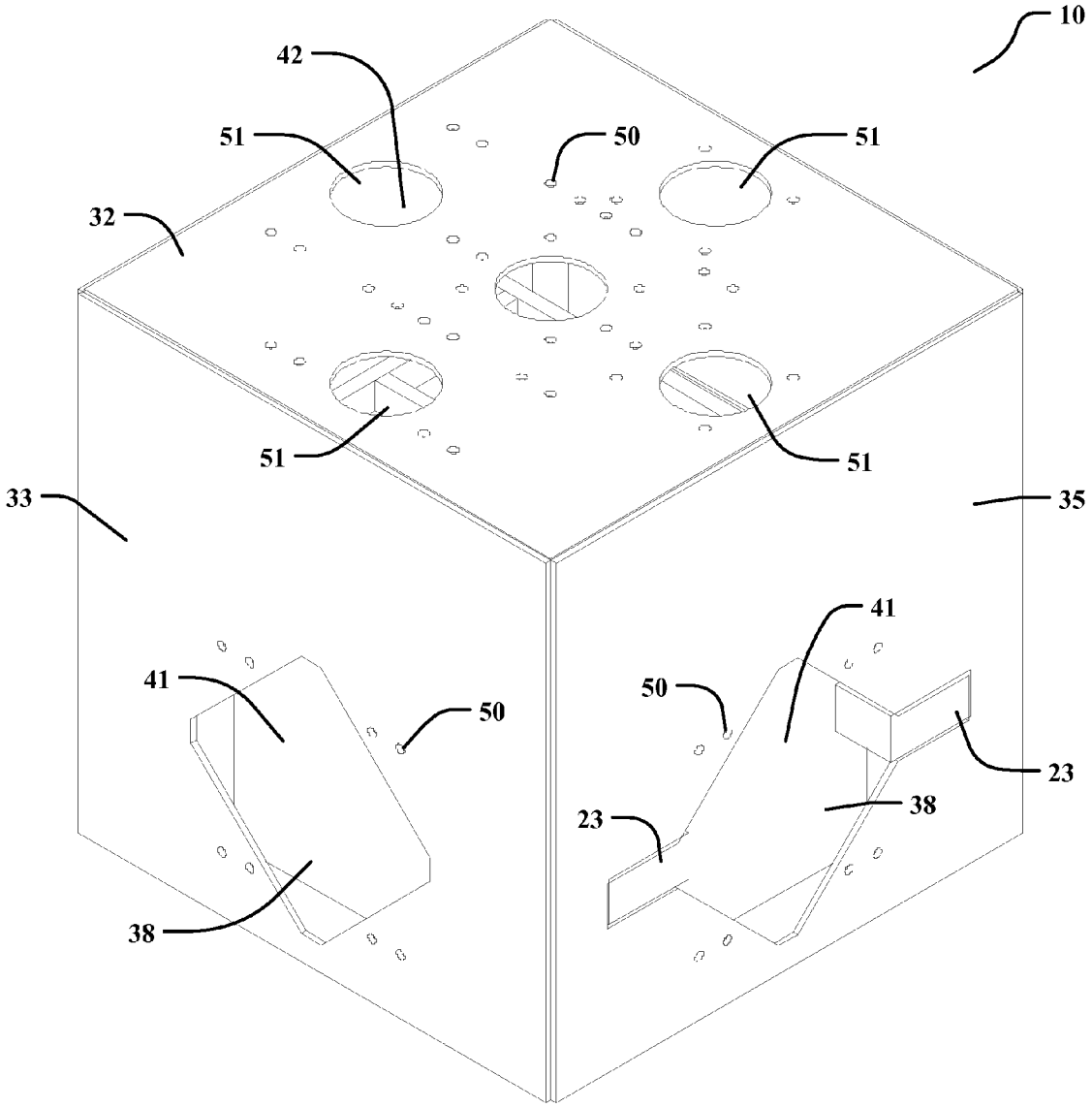
FIG. 1 is a perspective view of the invention.
Figure 2:
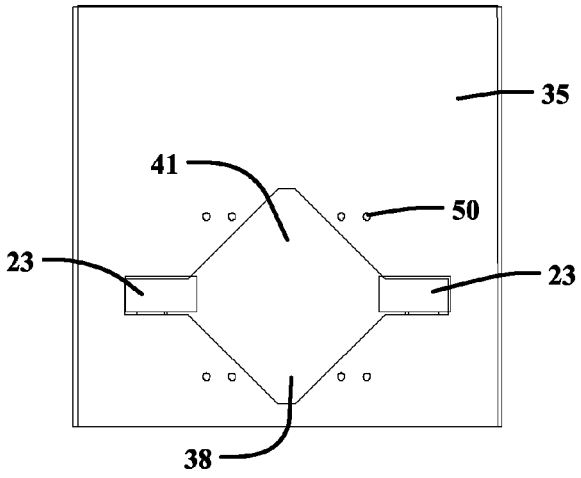
FIG. 2 is a front view of the invention.
Figure 3:
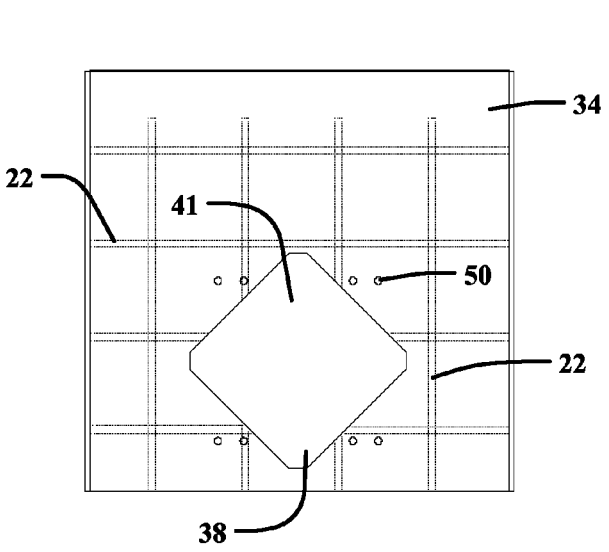
FIG. 3 is a side view of the invention.
Figure 4:
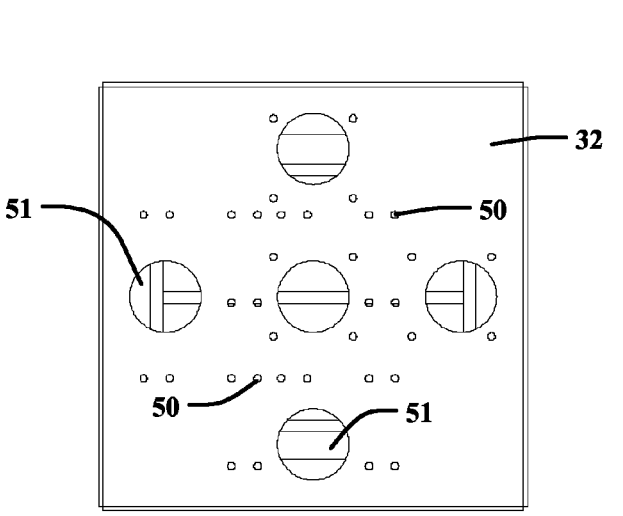
FIG. 4 is a top view of the invention.
Figure 5:
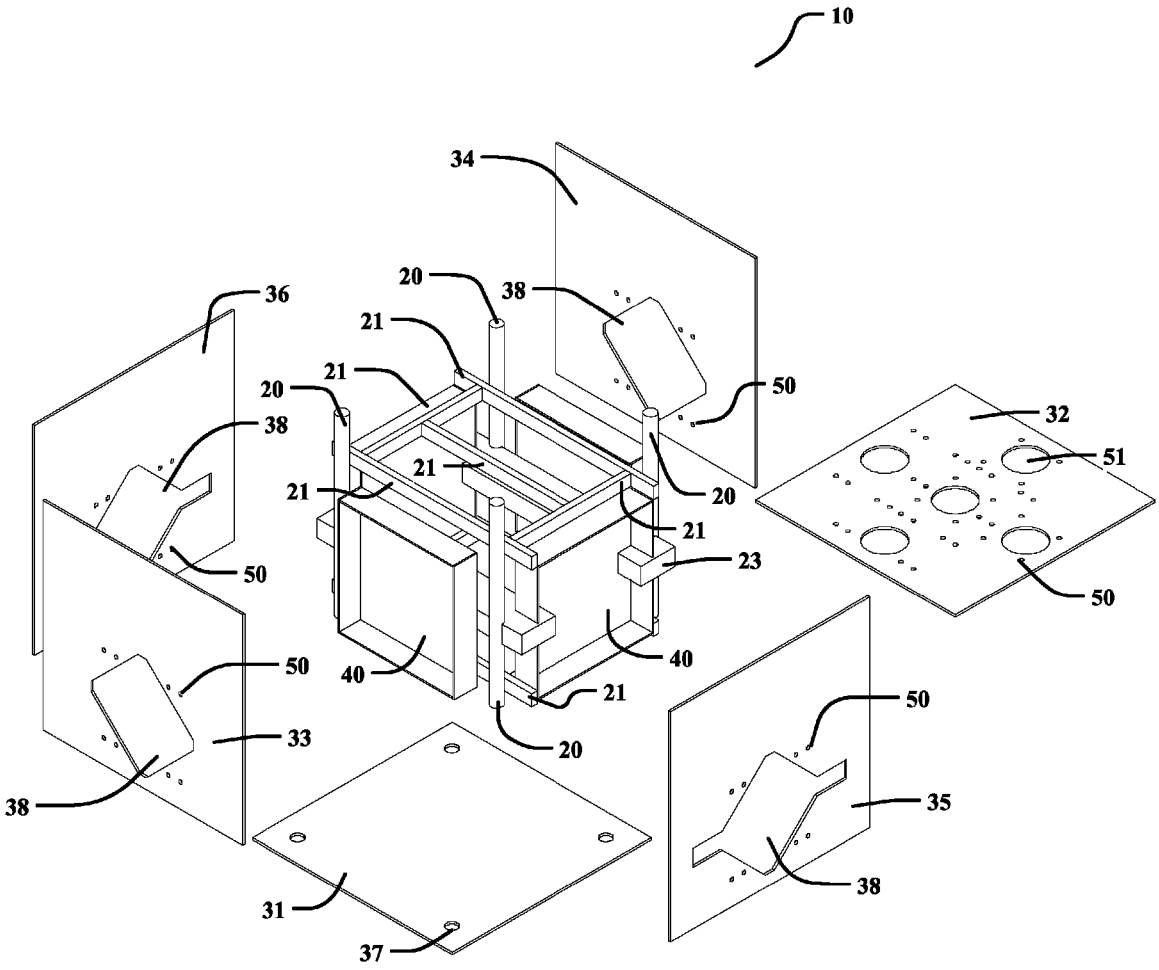
FIG. 5 is an exploded perspective view of the invention.
Figure 6A:
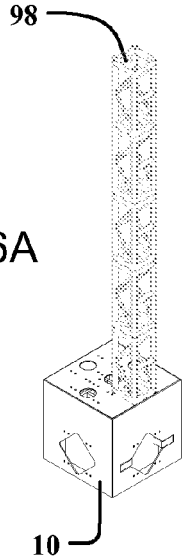
FIG. 6A is a perspective view of the invention with a vertically attached 12" box truss in a first position.
Figure 6B:
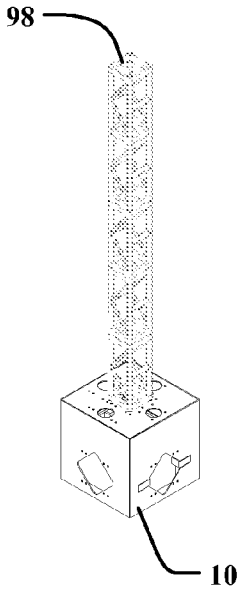
FIG. 6B is a perspective view of the invention with a vertically attached 12" box truss in a second position.
Figure 7:
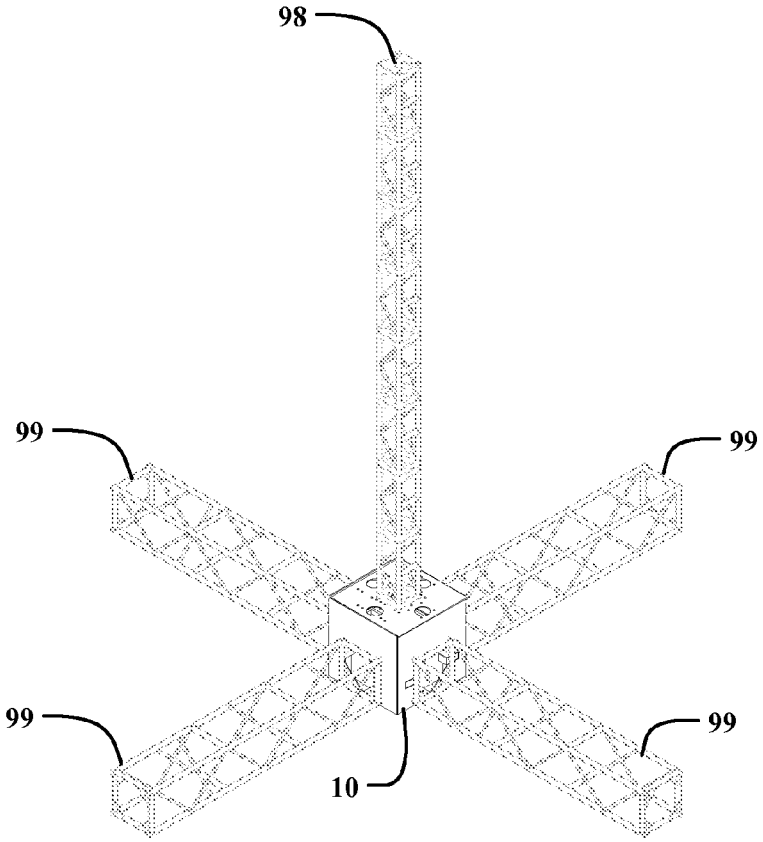
FIG. 7 is a perspective view of the invention with a vertically attached 12" box truss and several horizontally attached 20.5" box trusses.
Figure 8A:
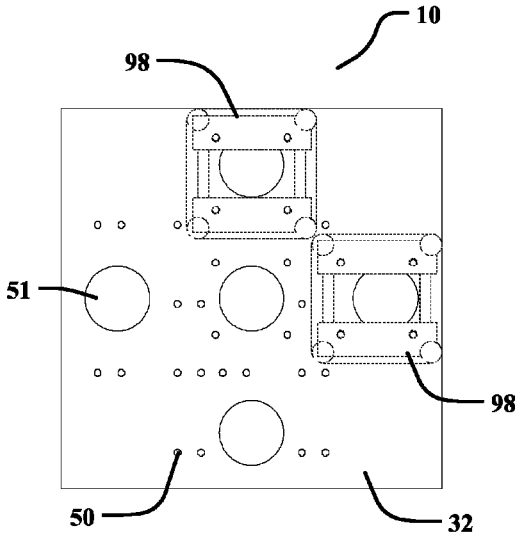
FIG. 8A is a top view of the invention displaying a first box truss attachment position.
Figure 8B:
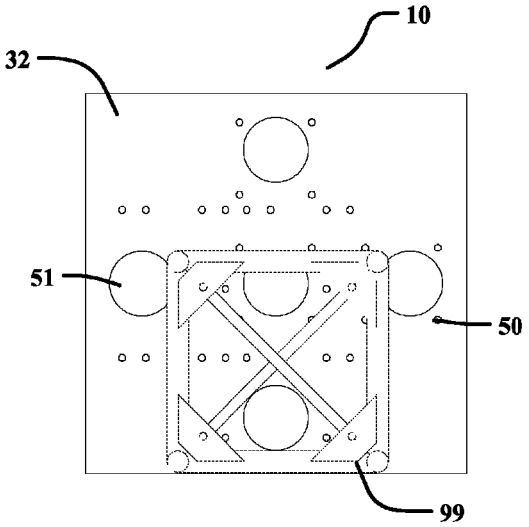
FIG. 8B is a top view of the invention displaying a second box truss attachment position.
Figure 8C:
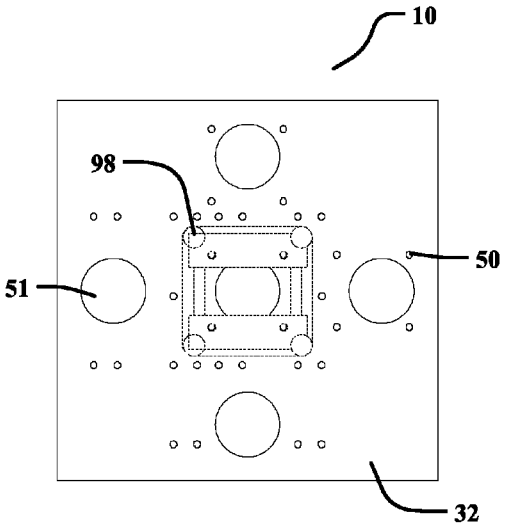
FIG. 8C is a top view of the invention displaying a third box truss attachment position.
Figure 8D:
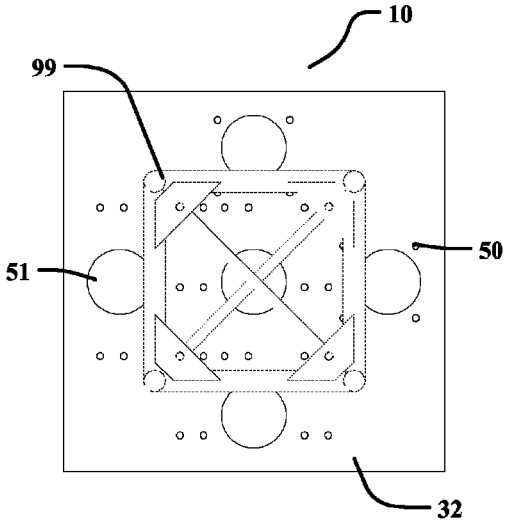
FIG. 8D is a top view of the invention displaying a fourth box truss attachment position.
Figure 9:
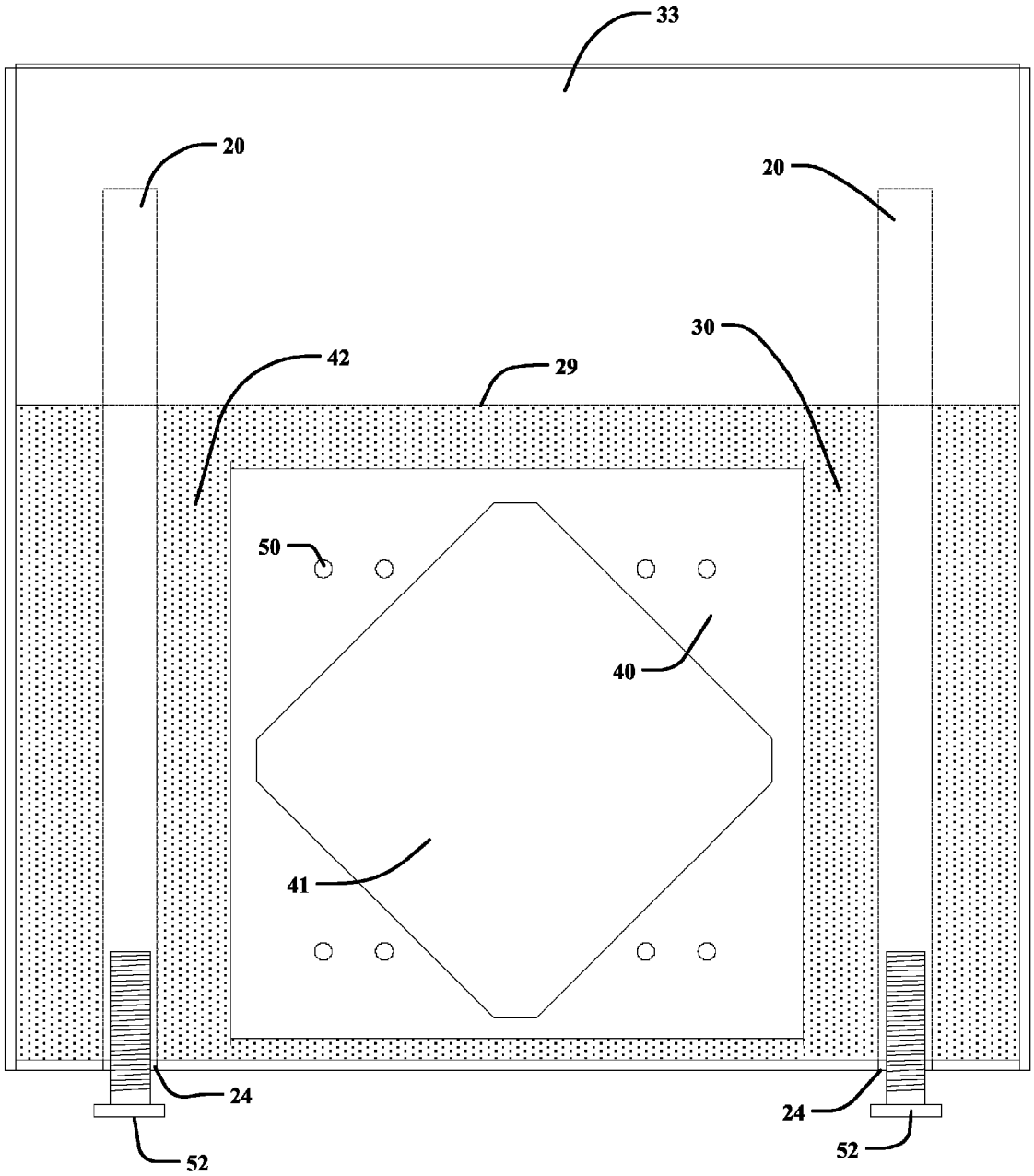
FIG. 9 is a perspective view of the invention with a leveling mechanism.

The present invention describes a deadweight 10 with truss attachment comprising a plurality of equally spaced vertical support members 20. The vertical support members 20 are positioned to form a square when viewed from the top (See FIG. 4). A plurality of support frames 21 are positioned horizontally between the support members 20, forming a cubic structure (See FIG. 1). The vertical support members 20 and support frames 21 will provide the general supporting structure of the deadweight 10. In an alternative embodiment, rebar 22 is positioned between each vertical support member 20 for additional structural support.

The deadweight 10 will further be filled with an aggregate material 30, increasing the overall weight of the deadweight 10 for stability and support. As such, a plurality of fork lift sleeves 23 are positioned perpendicular to said vertical support members 20 to aid in moving and positioning the deadweight 10. The fork lift sleeves 23 are parallel to each other and are hollow. The fork lift sleeves 23 are adapted to accept the forks of a traditional fork lift in both location and size.

The deadweight 10 comprises a plate on each face of the cube, defined as a bottom plate 31, top plate 32, left plate 33, right plate 34, front plate 35, and rear plate 36. The bottom plate 31 comprises several support apertures 37 for accepting the vertical support members 20 therethrough. The front plate 35, rear plate 36, left plate 33, and right plate 34 each have a rectangular aperture 38 therein. The front 35 and rear plates 36 are further adapted to expose the fork lift sleeves 23.

A plurality of enclosures 40 are positioned between each vertical support member 20 on each face of the deadweight 10, excluding the top 32 and the bottom 33. The purpose of the enclosures 40 is to create a working area 41 required for bolting a box truss 98, 99 to a plate 33, 34, 35, 36 on the deadweight 10. This is accomplished by restricting the aggregate material 30 to the internal compartment 42 created by the plates 31, 32, 33, 34, 35, 36. As such, the enclosures 40 are accessed through the rectangular apertures 38 on the front 35, rear 36, left 33, and right plates 34.

A plurality of bolt apertures 50 are placed on the top 32, left 33, right 34, front 35, and rear plates 36. These bolt apertures 50 are adapted to fit 12" trusses 98 and 20.5" trusses 99. Generally, the user will position the trusses 98, 99 on the desired plate 32, 33, 34, 35, 36, reach their hand through the rectangular apertures 38, and bolt the truss 98, 99 to the deadweight 10. The top plate 32 does not have a rectangular aperture 38, but comprises a plurality of circular hand apertures 51 adapted for a human hand to fit therein and insert bolts into the bolt apertures 50 of the top plate 32.

The plates 31, 33, 34, 35, 36 will create an internal compartment 42 within the deadweight 10 which is filled with the aggregate material 30. The enclosures 40 restrict the aggregate material 30 from the working area 41. Suitable aggregate materials 30 comprise cement, sand, concrete, or other heavy aggregate materials. A maximum fill level 29 is defined for the aggregate material 30, leaving room for a human hand to fit inside the internal compartment 42 and insert bolts into the top plate 32 bolt apertures 50. All other components are made from steel, although any durable metal can be used. Furthermore, trusses 98, 99, blocks, or other items can be welded to the deadweight 10 for permanent attachment.

The deadweight 10 is sized to provide ample space for 12" and 20.5" box trusses 98, 99 to attach. As such, the overall size of the deadweight 10 is 3'×3'. In an alternative embodiment, the overall size of the deadweight 10 is 2'×2'. Also, the bolt apertures 50 are adapted to mount a box truss 98, 99 flush to the top 32, left 33, right 34, front 35, and rear plates 36. The deadweight 10 can be adapted to support sized trusses with specialty plates, pipe systems, temporary antenna structures, or other mobile objects that are large, heavy, and have long uprights. Furthermore, a leveling mechanism 52 is adjustably attached to the base 24 of each support member 20. The leveling mechanism 52 is capable of self-leveling the deadweight 10.

Figure 10:
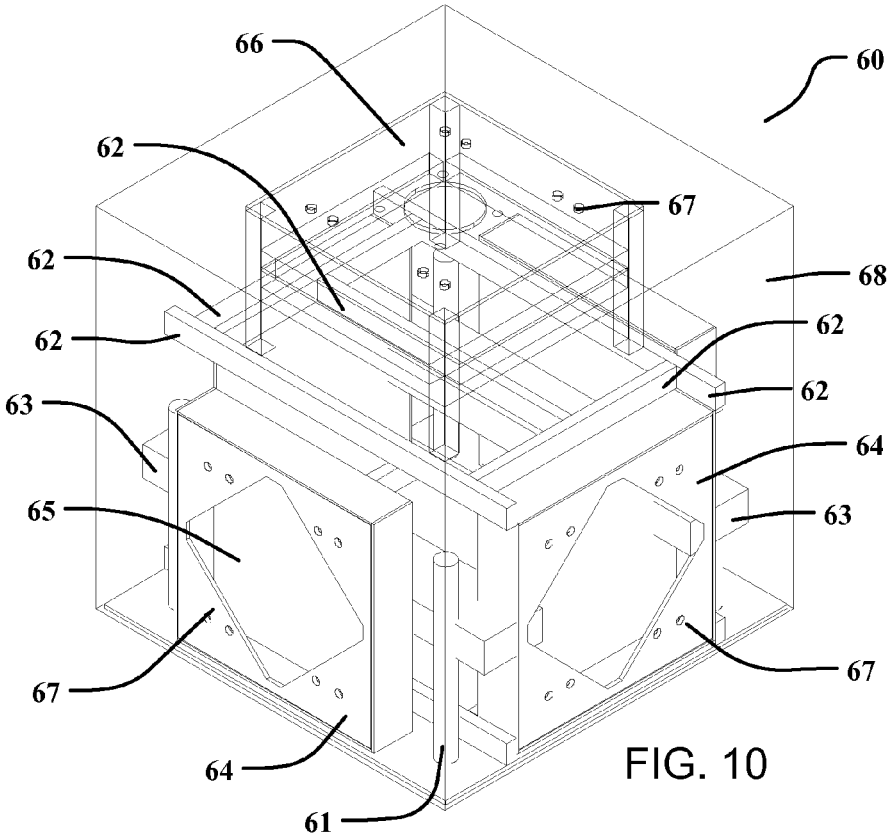
FIG. 10 is a perspective view of an alternative embodiment of the invention with an aggregate material.
Figure 11:
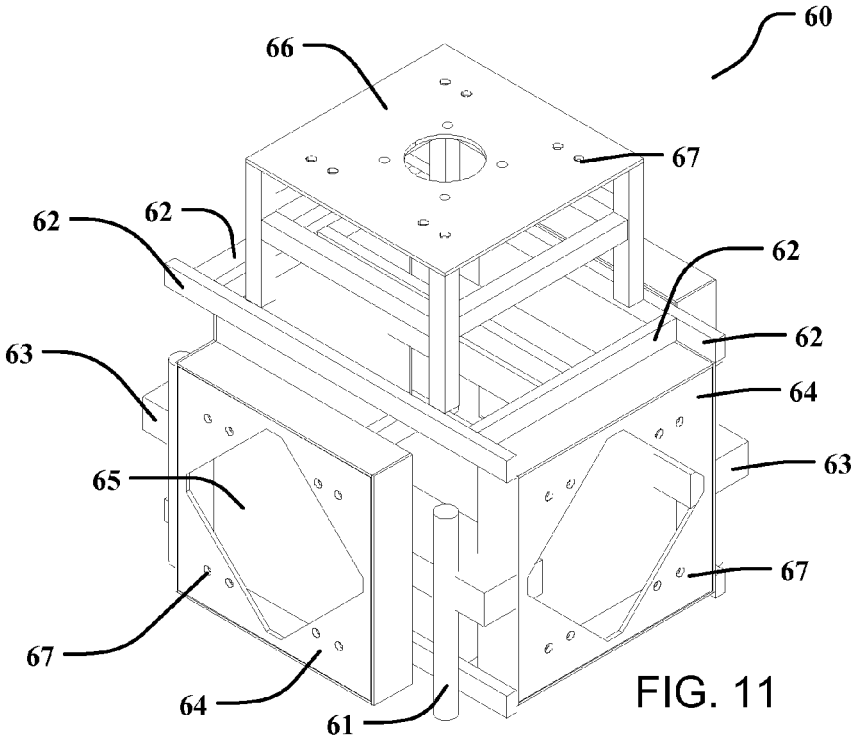
FIG. 11 is a perspective view of an alternative embodiment of the invention without an aggregate material.

In an alternative embodiment, a plurality of equally spaced vertical support members 61 are positioned with a plurality of horizontal support frames 62, forming a cubic structure (FIG. 10). A plurality of fork lift sleeves 63 are positioned perpendicular to the vertical support members 61 and a plurality of enclosures 64 are positioned between each vertical support member 61. However, each enclosure 64 has a rectangular aperture 65 therein, while no plates 31, 32, 33, 34, 35, 36 are positioned on the faces of the deadweight 60. A top frame 66 is positioned above the vertical support members 61, the fork lift sleeves 63, and the enclosures 64. Also, a plurality of bolt apertures 67 are positioned on the enclosures 64 and top frame 66. Here, the aggregate material 68 will surround the support members 61, the fork lift sleeves 63, the top frame 66, and the enclosures 64, but will leave the bolt apertures 67 exposed.

While a particular form of the invention has been illustrated and described, it will be apparent that various modifications can be made without departing from the spirit and scope of the invention. For example, alternative sizes, shapes, weights, and aperture positions can be changed without departing from the scope of the invention. Accordingly, it is not intended that the invention be limited, except as by the appended claims.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A deadweight with truss attachment comprising: a plurality of equally spaced vertical support members; a plurality of fork lift sleeves positioned perpendicular to said vertical support members; a plurality of enclosures positioned between each of said adjacent vertical support members; a bottom plate having support apertures for accepting said plurality of vertical support members; a top plate; a front plate, a rear plate, a left plate, and a right plate, each having a rectangular aperture therein for accessing said plurality of enclosures, said front and rear plates further adapted to expose said fork lift sleeves; wherein said bottom, top, front, rear, left, and right plates are arranged to form a closed interior area about said plurality of vertical support members; a plurality of bolt apertures on each of said top, front, rear, left, and right plates, said top plate having a plurality of hand apertures adapted for a human hand to fit therein and insert bolts into said plurality of bolt apertures; whereby said bottom plate, front plate, rear plate, left plate, right plate, and said plurality of enclosures are adapted to create an area capable of containing an aggregate material.

2. The deadweight with truss attachment of claim 1 further comprising a plurality of support frames positioned horizontally between said plurality of vertical support members.

3. The deadweight with truss attachment of claim 2 wherein said plurality of vertical support members and said plurality of support frames further comprise a size of 3'×3'.

4. The deadweight with truss attachment of claim 2 wherein said plurality of vertical support members and said plurality of support frames further comprise a size of 2'×2'.

5. The deadweight with truss attachment of claim 1 wherein said aggregate material further comprises a maximum fill level leaving room for a human hand to fit therein and insert bolts into said plurality of bolt apertures in said top plate.

6. The deadweight with truss attachment of claim 5 wherein said aggregate material is further comprised of concrete, cement, or sand.

7. The deadweight with truss attachment of claim 1 further comprising rebar positioned between each of said plurality of vertical support members.

8. The deadweight with truss attachment of claim 1 wherein said plurality of bolt apertures are adapted to support 12" and 20.5" truss structures.

9. The deadweight with truss attachment of claim 1 wherein said plurality of bolt apertures are adapted to mount a truss structure flush to said top, front, rear, left, and right plates.

10. The deadweight with truss attachment of claim 1 wherein said plurality of vertical support apertures are adapted to support sized trusses with specialty plates, pipe systems, or temporary antenna structures.

11. The deadweight with truss attachment of claim 1 further comprising a leveling mechanism adjustably attached to a base of each of said plurality of vertical support members.

12. The deadweight with truss attachment of claim 11 wherein the leveling mechanism further comprises a self-leveling mechanism.

* * * * *